United States Patent [19]

Székely et al.

[11] Patent Number: 4,560,485

[45] Date of Patent: Dec. 24, 1985

[54] FIRE-FIGHTING POWDERS

[75] Inventors: Éva Székely; Róza Székely, both of Budapest, Hungary

[73] Assignee: Magyar Szénhidrogénipari Kutató-Fejlesztö Intézet, Szászhalombatta, Hungary

[21] Appl. No.: 600,757

[22] Filed: Apr. 16, 1984

[30] Foreign Application Priority Data

Apr. 21, 1983 [HU] Hungary ..... 1387/83

[51] Int. Cl.[4] ..... A62D 1/00; A62D 1/06

[52] U.S. Cl. ..... 252/7; 252/5

[58] Field of Search ..... 252/7, 4, 5, 2, 6, 3; 169/43, 46; 106/15.05

[56] References Cited

U.S. PATENT DOCUMENTS

| | | | |
|---|---|---|---|
| 1,813,367 | 7/1931 | Thompson | 252/7 |
| 3,238,129 | 3/1966 | Veltman | 252/7 |
| 3,607,744 | 9/1971 | Cottrell | 252/7 |
| 3,714,047 | 1/1973 | Marion et al. | 252/7 |
| 3,826,764 | 7/1974 | Weber | 252/7 |
| 3,985,658 | 10/1976 | Riley et al. | 252/7 |
| 4,042,521 | 8/1977 | Dunn | 252/7 |

FOREIGN PATENT DOCUMENTS

| | | | |
|---|---|---|---|
| 0737470 | 1/1970 | Belgium | 252/7 |
| 0043967 | 4/1981 | Japan | 252/7 |
| 7301536 | 8/1973 | Netherlands | 252/7 |

OTHER PUBLICATIONS

Barnett et al., Inorganic Chemistry–A Textbook for Advanced Students, Longmans Green and Co., New York, p. 6.

*Primary Examiner*—Stephen J. Lechert, Jr.
*Assistant Examiner*—Howard J. Locker
*Attorney, Agent, or Firm*—Mandeville & Schweitzer

[57] ABSTRACT

The invention relates to fire-fighting powders providing per se or in mixtures an effective extinction of flames and embers.

The fire-fighting powder according to the invention comprises (a) at least one member of a group consisting of potassium, sodium and ammonium sesquicarbonate as active ingredient and optionally one or more metal salt catalysts; or (b) at least one metal salt catalyst in addition to substances having per se known extinguishing effect;

and optionally one or more other substances having per se known extinguishing effect as well as one or more additives generally used in the art.

The fire-fighting powders according to the invention have enhanced extinguishing effect as compared to the known extinctors.

7 Claims, No Drawings

FIRE-FIGHTING POWDERS

This invention relates to fire-fighting powders providing per se or in mixtures an effective extinction of flames and embers.

In general, the following compounds can be considered as active ingredients in various fire-fighting powders for extinguishing fires:

(a) sodium, potassium and ammonium carbonates and hydrocarbonates;

(b) sodium, potassium and ammonium phosphates, hydrophosphates and polyphosphates;

(c) sodium, potassium and ammonium sulphates and hydrosulphates;

(d) alkaline metal borates and boric acid;

(e) the adducts of the substances listed under (a) to (d) with urea, guanidine, dicyandiamide and melamine; and (f) polymers and polysaccharides.

The choice of the active ingredient depends upon the target of the use. According to German Pat. No. 2,814,034 the following fire-fighting powders are suggested: a powder based on phosphate or sulphate ion against fires (embers) of the class "A"; an other one based on hydrocarbonate or carbonate ion against fires of the classes "B" or "C" (liquids or gases); and a third one based on alkaline metal halides against fires of the class "D" (light metals). The most favourable fire-fighting powders of the practice contain adducts of potassium hydrocarbonate with urea or with dicyandiamide as active ingredient (German Pat. Nos. 2,348,926; 2,258,256 and 1,941,060; British Pat. Nos. 1,118,215, 1,168,262 and 1,190,132).

On heating a mixture consisting of potassium hydrocarbonate and urea, an adduct of the formula $KC_2N_2H_3O_3$ is formed, the fire-fighting ability of which is five times higher than that of the powders containing sodium hydrocarbonate, while two and a half times higher than that of the powders containing potassium hydrocarbonate. The above adducts are useful for extinguishing fires of the classes "B" and "C".

According to German Pat. No. 1,941,060 the above adducts can also be made useful for fighting a fire of the class "A" by adding at most 40 to 45 percent of ammonium phosphate and ammonium sulphate to the adduct.

It is known that the extinguishing ability is increased by diminishing the particle size range, however, the parameter of the ejectionability becomes deteriorated. In Hungarian Pat. No. 171,098 e.g. there are disclosed requirements for both the chemical and the physical parameters of the fire-fighting powders. Accordingly, the active ingredients (alkaline metal hydrocarbonates or alkaline metal carbonates) with a particle size range below 20 μm are mixed with 40 to 65 percent by weight of a spherical-shaped carrier having a particle size of 30 to 80 μm prepared from raw ceramic mass and at least one of the components is spray-dried. The fire-fighting powder described in German Pat. No. 1,098,368 contains 10 to 40 percent by weight of magnesium carbonate or calcium carbonate in addition to the sodium hydrocarbonate.

According to German Pat. No. 2,814,034 the active ingredients or their mixtures are mixed in the form of a melt or solution under pressure at a higher temperature and applied in the latter case to a defined carrier having large specific surface. The components described are alkaline metal phosphates, sulphates or hydrosulphates and hydrophosphates, respectively, as well as their mixtures; alkaline metal borates and boric acid or their mixtures, respectively; ammonium carbonate or hydrocarbonate; urea, dicyandiamide, guanidine and the like as well as the compounds obtained by the heat treatment of the above substances. Aluminium oxide, silicates and the like are used as carriers in an amount of 5 to 85 percent by weight.

The fire-fighting powder may contain of course other additives, such as hydrophobizing, fluidity-improving and colouring agents. In general, an alkaline earth stearate is used as hydrophobizing agent. According to German Pat. No. 2,814,034 the use of 0.1 to 3 percent by weight of an alkaline earth stearate and/or 0.1 to 1 percent of a silicone derivatives are suggested. Inert additives, such as talc, silicates, silicium dioxide, magnesium carbonate and barium sulphate are used for increasing the fluidity. The fire-fighting powder described in Swiss Pat. No. 38,166 e.g. contains 4 percent by weight of talc and 6 percent by weight of bentonite, in addition to 90 percent by weight of sodium hydrocarbonate.

Present invention was based on the discovery, that the extinguishing ability of a fire-fighting powder can be surprisingly increased by the addition of an alkaline metal and/or ammonium sesquicarbonate. Additionally, it was found that the extinguishing ability of said fire-fighting powder can be further improved by adding a metal salt catalyst to it. Finally it was found that the fire-fighting ability of known fire-fighting powders also can be increased by the addition of a metal salt catalyst.

Sesquicarbonates according to the general formula of $xMe_2CO_3.yMeHCO_3.2H_2O$, wherein Me represents alkaline metal or ammonium are commercially available well-known compounds. Sodium sesquicarbonate has the formula of $Na_2CO_3.NaHCO_3.2H_2O$, while potassium sesquicarbonate corresponds to formula $K_2CO_3.2KHCO_3.1,5H_2O$. The fact that the fire-fighting powders containing a hydrocarbonate compound as active ingredient produced by different plants have different extinguishing ability in spite of their identical particel size distribution is due to the presence of a small but different amount of sesquicarbonate in the surface layer of the hydrocarbonate particles, as the composition of the surface layer depends on the various manufacturing processes.

On the basis of our investigations it was discovered that the rate of formation of the inert gases evolved in the reaction and the extent of the heat effect of the reaction play a primary role in the fire-fighting. It was found that the efficiency of the extinction is extremely enhanced by adding a metal catalyst, preferably a transition metal catalyst to the active ingredient.

The fire-fighting powder according to the invention comprises (a) at least one member of a group consisting of potassium, sodium and ammonium sesquicarbonate as active ingredient and optionally one or more metal catalysts; or (b) one or more metal salt catalysts in addition to substances having per se known extinguishing effect; and optionally contains one or more other substances having per se known extinguishing effect as well as one ore more additives generally used in the art.

The fire-fighting powder according to the invention contains a sesquicarbonate preferably in an amount of 10 to 95 percent by weight.

The metal salt catalysts according to the invention can be used to enhance the extinguishing ability both in the powders containing sesquicarbonates and in the per se known fire-fighting powder compositions. As catalysts water-soluble metal salts, preferably transition metal salts e.g. copper, nickel, manganese, chromium and iron salts can be employed, though a mixture of said salts may also be used. These salts are fused or crystallized from a solution together with the active ingredient. The catalysts are added generally in an amount of 0.1 to 10 percent by weight, preferably 1 to 6 percent by weight.

As a substance having per se known extinguishable effect can be mentioned e.g. sodium, potassium, ammonium hydrosulphates, sulphates, hydrophosphates, phosphates, hydrocarbonates, carbonates and halides, alkaline metal borates and boric acid, as well as their adducts with urea, guanidine, dicyandiamide or melamine. The fire-fighting powder of the invention can contain one or more of the above substances in an amount of 0 to 90 percent by weight.

The fire-fighting powder according to the invention may contain one or more additives generally used in the art. As hydrophobizing agent e.g. calcium, magnesium, zinc or aluminium stearate at most in an amount of 3 percent by weight and/or a silicone derivative at most in an amount of 1 percent by weight can be employed.

For improving the fluidity e.g. hydrophilic or hydrophobized forms of silicates, talc, bentonite and the like of a particle size of 0.1 to 150 $\mu$m may be used as inert carriers.

The particle size range of the fire-fighting powders according to the invention is 1 to 200 $\mu$m. The more confined range depends on the amount of the inert carrier used in addition to the active ingredient.

The fire-fighting powder of the invention can be produced by any method known in the art, i.e. the components can be mixed using a dry process or they can be melted and the melt obtained is grounded after cooling, or the components can be spray-dried or crystallized together.

Further details of the invention are to be illustrated by the following non-limiting Examples.

EXAMPLE 1

| | percent by weight |
|---|---|
| Sodium sesquicarbonate ($Na_3H_5C_2O_7$) | 95 |
| Magnesium stearate (hydrophobizing additive | 3 |
| Calcium sulphate (inert additive) | 2 |

The components were mixed dry in a rotating pan for a time interval of at least two hours over the time of homogenation determined by microscopic examination.

EXAMPLE 2

| | percent by weight |
|---|---|
| Potassium sesquicarbonate ($K_4H_5C_3O_{10.5}$) | 90 |
| Nickel chloride (catalyst) | 6 |
| Magnesium stearate (hydrophobizing additive) | 2 |
| Silica gel (inert additive) | 1 |
| Talc (inert additive) | 1 |

Potassium sesquicarbonate and nickel chloride were dissolved in water and the solution was spray-dried giving a powder which was then homogenized with the hydrophobizing and inert additives as described in Example 1.

EXAMPLE 3

| | percent by weight |
|---|---|
| Sodium sesquicarbonate ($Na_3H_5C_2O_7$) | 30 |
| Sodium hydrocarbonate | 60 |
| Calcium stearate (hydrophobizing additive) | 2 |
| Aluminium oxide (inert additive) | 8 |

The fire-fighting powder was prepared according to Example 1.

EXAMPLE 4

| | percent by weight |
|---|---|
| Sodium sesquicarbonate ($Na_3H_5C_2O_7$) | 30 |
| Sodium hydrocarbonate | 60 |
| Calcium stearate (hydrophobizing additive) | 2 |
| Barium sulphate (inert additive) | 8 |

The ingredients were mixed wet and spray-dried and/or they were mixed dry.

EXAMPLE 5

| | percent by weight |
|---|---|
| Urea ($CO/NH_2/_2$) | 50 |
| Sodium hydrocarbonate | 35 |
| Chromic sulphate (catalyst) | 1 |
| Nickel chloride (catalyst) | 6 |
| Magnesium stearate (hydrophobizing additive) | 2 |
| Bentonite (inert additive) | 6 |

Sodium hydrocarbonate and the chromium and nickel salt catalysts were mixed into the urea fused at a temperature of 140° C. and kept under a pressure of 2 to 5 bars for 0.2 to 2 hours. The melt was cooled, ground and homogenized dry with the remaining additives in a rotating pan.

EXAMPLE 6

The process described in Example 5 was followed except that at most 40 percent of inert additives (as calculated for the active ingredient) were mixed in dry state or all ingredients were mixed wet and spray-dried.

EXAMPLE 7

The process described in Examples 5 and 6 was followed except that the mixture contained 5 percent of a nickel salt catalyst as calculated for the total active ingredients content.

EXAMPLE 8

For studying the extinguishing ability, a diminished image of a standard fire model of the class "B" was used consisting of an air blower providing an air flow of 2 $dm^3$/min; of a nozzle fitted with a powder container of 3 g capacity and of series of metal trays having diameters of 3, 5.5, 7, 9 and 11 cm, respectively.

The trays of 1 cm in height were filled with water to a height of 0.5 cm whereupon gasoline was poured onto it up to a height of 0.4 cm. One g of the powder to be tested was placed in the powder container of the nozzle. The gasoline poured into the trays was lighted and after a fore-burning for 10 minutes, the air flow was set on the nozzle and the powder was introduced into the flame zone. Experiments were repeated with trays of larger diameter until the tray was found wherein the powder weighed in was not able to extinguish the fire anymore.

In the fire-fighting experiments, powders of the following composition were used:

| | percent by weight |
|---|---|
| Active ingredient and optionally used catalyst | 97 |
| Hydrophobizing additive | 2 |
| $Al_2O_3$ powder | 1 |

Results of the fire-fighting experiments are shown in the following Table.

TABLE

Extinguishing effect of the fire-fighting powders

| Experiment No. | Substance having known extinguishing effect | Amount (%) | Sesquicarbonate | Amount (%) | Metal salt | Amount (%) | Dimension of the extinguished fire (diameter of the tray) cm |
|---|---|---|---|---|---|---|---|
| 1 | $NaHCO_3$ | 95 | — | | $NiCl_2$ | 2 | 5 |
| 2 | urea $NaHCO_3$ adduct | 94 | — | | $NiCl_2$ | 3 | 9 |
| 3 | $NH_4$ phosphate | 95 | — | | $CoCl_2$ | 2 | 3.5 |
| 4 | — | | Sodium | 97 | — | | 7 |
| 5 | — | | Sodium | 92 | $NiCl_2$ | 5 | 7 |
| 6 | urea $NaHCO_3$ adduct | 77 | Sodium | 20 | — | | 7 |
| 7 | urea $NaHCO_3$ adduct | 75 | Sodium | 20 | $NiCl_2$ | 2 | 7 |
| 8 | $KHCO_3$ | 77 | Potassium | 20 | — | | 5 |
| 9 | NaF | 10 | Sodium | 85 | $CoCl_2$ | 2 | 7 |
| 10 | urea $NaHCO_3$ adduct | 57 | Sodium | 20 | — | | 9 |
| | $K_2SO_4$ | 20 | | | | | |
| 11 | urea $NaHCO_3$ adduct | 20 | Sodium | 20 | $NiCl_2$ | 2 | 9 |
| | $K_2SO_4$ | 20 | | | | | |
| 12 | Fire-fighting powder "Granito" (produced by BIRO Fiels, France) | | | | | | 3.5 |
| 13 | Fire-fighting powder "Pyromatt" (produced by Elzett Muvek, Hungary) | | | | | | 3.5 |

What we claim is:

1. A fire fighting powder composition, comprising:

(a)

(1) at least one sesquicarbonate of potassium, sodium and ammonium in an amount of from about 10 to about 95% by weight, or (2) at least one of (i) bisulfate, sulfate, biphosphate, phosphate, bicarbonate, sesquicarbonate, carbonate and halide, of at least one of sodium, potassium and ammonium, (ii) alkaline metal borate, (iii) boric acid, and (iv) their adducts with at least one of urea, guanidine, melamine and dicyandiamide, in an amount of about 5% to about 90% by weight, (b) a water soluble metal salt catalyst which is at least one salt of at least one of copper, nickel, manganese, cobalt, chromium and iron in an amount of from 0.1% to 10% by weight, and (c) a hydrophobizing agent which is at least one of a metal stearate and a silicone derivative in an amount of 1% to 3% by weight.

2. The fire-fighting powder composition of claim 1, which further comprises an inert carrier.

3. The fire-fighting powder composition of claim 2, wherein said inert carrier comprises at least one of a bentonite, a silicate and talc.

4. The fire-fighting powder composition of claim 2, wherein said hydrophobizing agent is at least one of a metal stearate and and a silicone derivative, and wherein said inert carrier comprises at least one of a bentonite, a silicate and talc.

5. The fire-fighting powder composition of claim 1, wherein the particle size of the powder composition is between 1 and 200 micrometers.

6. The fire-fighting powder composition of claim 1, wherein at least one of the ingredients is spray dried and/or mixed with the remaining material.

7. The fire-fighting powder composition of claim 1, wherein the ingredients are mixed in the molten state, then cooled, ground or pulverized.

* * * * *